US007588872B2

(12) United States Patent
Lin et al.

(10) Patent No.: US 7,588,872 B2
(45) Date of Patent: Sep. 15, 2009

(54) PHOTORECEPTOR

(75) Inventors: Liang-Bih Lin, Rochester, NY (US); Jin Wu, Webster, NY (US); Daniel V. Levy, Rochester, NY (US); Cindy C. Chen, Rochester, NY (US); Richard H. Nealey, Plymouth, MA (US); Kenny-Tuan Dinh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 261 days.

(21) Appl. No.: 11/463,050

(22) Filed: Aug. 8, 2006

(65) Prior Publication Data

US 2008/0038651 A1 Feb. 14, 2008

(51) Int. Cl.
*G03G 5/047* (2006.01)

(52) U.S. Cl. ..... 430/59.1; 430/58.05

(58) Field of Classification Search ..... 430/58.05, 430/58.4, 58.55, 58.65, 59.1
See application file for complete search history.

(56) References Cited

U.S. PATENT DOCUMENTS

| | | | | |
|---|---|---|---|---|
| 3,121,006 | A | 2/1964 | Middleton et al. | |
| 4,050,935 | A | 9/1977 | Limburg et al. | |
| 4,281,054 | A | 7/1981 | Horgan et al. | |
| 4,297,425 | A | 10/1981 | Pai et al. | |
| 4,298,697 | A | 11/1981 | Baczek et al. | |
| 4,338,390 | A | 7/1982 | Lu | |
| 4,415,640 | A | 11/1983 | Goto et al. | |
| 4,560,635 | A | 12/1985 | Hoffend et al. | |
| 4,599,286 | A | 7/1986 | Limburg et al. | |
| 5,178,980 | A * | 1/1993 | Mort et al. | 430/58.05 |
| 5,336,577 | A | 8/1994 | Spiewak et al. | |
| 5,681,679 | A | 10/1997 | Schank et al. | |
| 5,702,854 | A | 12/1997 | Schank et al. | |
| 5,800,950 | A * | 9/1998 | Hirao et al. | 430/1 |
| 5,976,744 | A | 11/1999 | Fuller et al. | |
| 6,884,404 | B2 * | 4/2005 | Anazawa et al. | 423/447.1 |
| 2002/0172878 | A1 * | 11/2002 | Nakamura | 430/59.1 |
| 2003/0035917 | A1 * | 2/2003 | Hyman | 428/67 |
| 2004/0041508 | A1 * | 3/2004 | Sugino et al. | 313/309 |
| 2005/0123846 | A1 * | 6/2005 | Kinoshita | 430/60 |
| 2005/0233235 | A1 * | 10/2005 | Qi et al. | 430/66 |

FOREIGN PATENT DOCUMENTS

| | | |
|---|---|---|
| DE | 25 50 630 A1 | 5/1977 |
| EP | 0 368 252 A2 | 5/1990 |
| EP | 0 896 975 A1 | 2/1999 |
| JP | A-55-45024 | 3/1980 |
| JP | A-2006-084987 | 3/2006 |

OTHER PUBLICATIONS

T. Durkop et al., "Extraordinary Mobility in Semiconducting Carbon Nanotubes," Nano. Lett., vol. 4, No. 1, 35-39 (2004).
Cao et al., "Photoconductivity Study of Modified Carbon Nanotube/Oxotitanium Phthalocyanine Composites," Journal of Physical Chemistry B, Aug. 7, 2002, pp. 8971-8975, vol. 106.
Yang et al., "Nanoscale azo pigment immobilized on carbon nanotubes via liquid phase reprecipitation approach," Materials Letters, Jul. 1, 2004, pp. 2238-2242, vol. 58, No. 17-18.
Yang et al., "Synthesis and photoconductivity study of carbon nanotube bonded by tetrasubstituted amino manganese phthalocyanine," Materials Science and Engineering B, Jan. 15, 2004, pp. 73-78, vol. 106, No. 1.
Xu et al., "Poly(triphenylamine) related copolymer noncovalently coated MWCNT nanohybrid: fabrication and observation of enhanced photoconductivity," Nanotechnology, Jan. 10, 2006, pp. 728-733, vol. 17.

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

An electrophotographic imaging member includes a substrate, an optional intermediate (undercoat) layer, a photogenerating layer, which can be a single layer of include separate charge generating and charge transport layers, and an optional overcoating layer, wherein the photogenerating layer or a sub-layer thereof include a carbon nanotube material.

17 Claims, No Drawings

PHOTORECEPTOR

TECHNICAL FIELD

This disclosure is generally directed to electrophotographic imaging members and, more specifically, to layered photoreceptor structures where a single active layer includes carbon nanotubes and performs both charge generating and hole transport functions. This disclosure also relates to processes for making and using the imaging members.

RELATED APPLICATIONS

Commonly assigned U.S. patent application Ser. No. 11/463,048, filed concurrently herewith describes an electrophotographic imaging member comprising: a substrate, a photogenerating layer, and an optional overcoating layer wherein the photogenerating layer comprises a chemically functionalized carbon nanotube material.

Commonly assigned U.S. patent application Ser. No. 11/463,082, filed concurrently herewith describes an electrophotographic imaging member comprising: a substrate, a photogenerating layer, and an optional overcoating layer wherein the photogenerating layer comprises a multi-block polymeric charge transport material at least partially embedded within a carbon nanotube material.

Commonly assigned U.S. patent application Ser. No. 11/463,118, filed concurrently herewith describes an electrophotographic imaging member comprising: a substrate, a photogenerating layer, and an optional overcoating layer wherein the photogenerating layer comprises a self-assembled carbon nanotube material having pendant charge transport materials.

The appropriate components and process aspects of each of the foregoing, such as the photoreceptor materials and processes, may be selected for the present disclosure in embodiments thereof. The entire disclosures of the above-mentioned applications are totally incorporated herein by reference.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,681,679 discloses a flexible electrophotographic imaging member including a supporting substrate and a resilient combination of at least one photoconductive layer and an overcoating layer, the at least one photoconductive layer comprising a hole transporting arylamine siloxane polymer and the overcoating comprising a crosslinked polyamide doped with a dihydroxy amine. This imaging member may be utilized in an imaging process including forming an electrostatic latent image on the imaging member, depositing toner particles on the imaging member in conformance with the latent image to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating. The electrophotographic imaging member may be imaged in a process.

U.S. Pat. No. 4,297,425 discloses a layered photosensitive member comprising a generator layer and a transport layer containing a combination of diamine and triphenyl methane molecules dispersed in a polymeric binder.

U.S. Pat. No. 4,050,935 discloses a layered photosensitive member comprising a generator layer of trigonal selenium and a transport layer of bis(4-diethylamino-2-methylphenyl) phenylmethane molecularly dispersed in a polymeric binder.

U.S. Pat. No. 4,281,054 discloses an imaging member comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 discloses an electrophotographic imaging member comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

U.S. Pat. No. 4,415,640 discloses a single layered charge generating/charge transporting light sensitive device. Hydrazone compounds, such as unsubstituted fluorenone hydrazone, may be used as a carrier-transport material mixed with a carrier-generating material to make a two-phase composition light sensitive layer. The hydrazone compounds are hole transporting materials but do not transport electrons.

U.S. Pat. No. 5,336,577 discloses an ambipolar photoresponsive device comprising: a supporting substrate; and a single organic layer on said substrate for both charge generation and charge transport, for forming a latent image from a positive or negative charge source, such that said layer transports either electrons or holes to form said latent image depending upon the charge of said charge source, said layer comprising a photoresponsive pigment or dye, a hole transporting small molecule or polymer and an electron transporting material, said electron transporting material comprising a fluorenylidene malonitrile derivative; and said hole transporting polymer comprising a dihydroxy tetraphenyl benzidine containing polymer.

Japanese Patent Application Publication No. 2006-084987 describes a photoconductor for electrophotography, characterized by an undercoating layer containing a carbon nanotube.

The disclosures of each of the foregoing patents and applications are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and other materials. In addition, the imaging member may be layered in which each layer making up the member performs a certain function. Current layered organic imaging members generally have at least a substrate layer and two electro or photo active layers. These active layers generally include (1) a charge generating layer containing a light-absorbing material, and (2) a charge transport layer containing charge transport molecules or materials. These layers can be in a variety of orders to make up a functional device, and sometimes can be combined in a single or mixed layer. The substrate layer may be formed from a conductive material. Alternatively, a conductive layer can be formed on a nonconductive inert substrate by a technique such as but not limited to sputter coating.

The charge generating layer is capable of photogenerating charge and injecting the photogenerated charge into the charge transport layer or other layer.

In the charge transport layer, the charge transport molecules may be in a polymer binder. In this case, the charge transport molecules provide hole or electron transport properties, while the electrically inactive polymer binder provides mechanical properties. Alternatively, the charge transport layer can be made from a charge transporting polymer such as a vinyl polymer, polysilylene or polyether carbonate, wherein the charge transport properties are chemically incorporated into the mechanically robust polymer.

Imaging members may also include a charge blocking layer(s) and/or an adhesive layer(s) between the charge generating layer and the conductive substrate layer. In addition, imaging members may contain protective overcoatings. These protective overcoatings can be either electroactive or inactive, where electroactive overcoatings are generally preferred. Further, imaging members may include layers to provide special functions such as incoherent reflection of laser light, dot patterns and/or pictorial imaging or subbing layers to provide chemical sealing and/or a smooth coating surface.

Imaging members are generally exposed to repetitive electrophotographic cycling, which subjects the exposed charge transport layer or alternative top layer thereof to mechanical abrasion, chemical attack and heat. This repetitive cycling leads to a gradual deterioration in the mechanical and electrical characteristics of the exposed charge transport layer.

Although excellent toner images may be obtained with multilayered belt or drum photoreceptors, it has been found that as more advanced, higher speed electrophotographic copiers, duplicators and printers are developed, there is a greater demand on print quality. A delicate balance in charging image and bias potentials, and characteristics of the toner and/or developer, must be maintained. This places additional constraints on the quality of photoreceptor manufacturing, and thus, on the manufacturing yield.

Despite the various approaches that have been taken for forming imaging members, there remains a need for improved imaging member design, to provide improved imaging performance, longer lifetime, and the like.

SUMMARY

This disclosure addresses some or all of the above problems, and others, by providing imaging members where a single active layer, also called a photogenerating layer, includes carbon nanotubes and performs both charge generating and hole transport functions.

In an embodiment, the present disclosure provides an electrophotographic imaging member comprising:

a substrate, an optional intermediate (undercoating) layer, a photogenerating layer, and an optional overcoating layer wherein the photogenerating layer comprises a carbon nanotube material. If desired, the photogenerating layer can include separate charge generating and charge transport layers.

In another embodiment, the present disclosure provides a process for forming an electrophotographic imaging member comprising:

providing an electrophotographic imaging member substrate, and applying a photogenerating layer over the substrate, wherein the photogenerating layer comprises a carbon nanotube material.

In embodiments, the photogenerating layer can further comprise a film-forming binder, a charge generating material, and a charge transporting material.

The present disclosure also provides electrographic image development devices comprising such electrophotographic imaging members. Also provided are imaging processes using such electrophotographic imaging members.

EMBODIMENTS

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole transport layer is formed on the charge generation layer, followed by an optional overcoat layer. This structure may have the charge generation layer on top of or below the hole transport layer. In embodiments, the charge generating layer and hole transport layer can be combined into a single active layer that performs both charge generating and hole transport functions.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may be applied to the hole blocking layer. Any suitable adhesive layer known in the art may be utilized. Typical adhesive layer materials include, for example, polyesters, polyurethanes, and the like. Satisfactory results may be achieved with adhesive layer thickness of about 0.05 micrometer (500 angstroms) to about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

At least one electrophotographic imaging layer is formed on the adhesive layer, blocking layer or substrate. The electrophotographic imaging layer may be a single layer that performs both charge generating and hole or charge transport functions or it may comprise multiple layers such as a charge generator layer and a separate hole or charge transport layer. However, in embodiments, the electrophotographic imaging layer is a single layer that performs all charge generating, electron and hole transport functions.

The photogenerating layer generally comprises a film-forming binder, a charge generating material, and a charge transporting material, although the photogenerating layer can also comprises an inorganic charge generating material in film form, along with a charge transporting material. For example, suitable inorganic charge generating materials in film form can include amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layer may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms which have a strong influence on photogeneration.

Any suitable polymeric film forming binder material may be employed as the matrix in the photogenerating layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 0.1 percent by volume to about 90 percent by volume, such as about 0.5 percent by volume to about 50 percent by volume or about 1 percent by volume to about 10 or to about 20 percent by volume, of the photogenerating pigment is dispersed in about 10 percent by volume to about 95 percent by volume, such as about 30 percent by volume to about 70 percent by volume or about 50 percent by volume to about 60 percent by volume of the resinous binder. The photogenerating layer can also be fabricated by vacuum sublimation in which case there is no binder.

In embodiments where the photogenerating layer performs both charge generating and hole transporting functions, the layer can also include a hole transporting small molecule dissolved or molecularly dispersed in the film forming binder, such as an electrically inert polymer such as a polycarbonate. The term "dissolved" as employed herein is defined herein as forming a solution in which the small molecule is dissolved in the polymer to form a homogeneous phase. The expression "molecularly dispersed" as used herein is defined as a hole transporting small molecule dispersed in the polymer, the small molecules being dispersed in the polymer on a molecular scale. Any suitable hole transporting or electrically active small molecule may be employed in the hole transport layer. The expression hole transporting "small molecule" is defined herein as a monomer that allows the free charge photogenerated in the transport layer to be transported across the transport layer. Typical hole transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule hole transporting compounds are dissolved or molecularly dispersed in electrically inactive polymeric film forming materials. Small molecule hole transporting compounds that permit injection of holes from the pigment into the photogenerating layer with high efficiency and transport them across the layer with very short transit times are N,N'-diphenyl-N,N'-bis(3-methylphenyl)-(1,1'-biphenyl)-4,4'-diamine, N,N,N',N'-tetra-p-tolylbiphenyl-4,4'-diamine, and N,N'-Bis(3-methylphenyl)-N,N'-bis[4-(1-butyl)phenyl]-[p-terphenyl]-4,4'-diamine. If desired, the hole transport material may comprise a polymeric hole transport material or a combination of a small molecule hole transport material and a polymeric hole transport material.

Any suitable electrically inactive resin binder insoluble in a solvent such as an alcohol solvent used to apply any subsequent (overcoat) layer may be employed. Typical inactive resin binders include those binder materials mentioned above. Molecular weights can vary, for example, from about 20,000 to about 150,000. Exemplary binders include polycarbonates such as poly(4,4'-isopropylidene-diphenylene)carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable hole transporting polymer may also be utilized in the photogenerating layer. The hole transporting polymer should be insoluble in any solvent employed to apply the subsequent overcoat layer described below, such as an alcohol solvent. These electrically active hole transporting polymeric materials should be capable of supporting the injection of photogenerated holes and be incapable of allowing the transport of these holes therethrough.

The photogenerating layer further comprises electron transport materials dissolved or molecularly dispersed in the film forming binder. In embodiments, the electron transport material comprises carbon nanotubes, carbon nanofibers, or variants thereof, generically referred to herein as carbon nanotube material. As the carbon nanotube material, any of the currently known or after-developed carbon nanotube materials and variants can be used. Thus, for example, the carbon nanotubes can be on the order of from about 0.1 to about 50 nanometers in diameter, such as about 1 to about 10 nanometers in diameter, and up to hundreds of micrometers or more in length, such as from about 0.01 or about 10 or about 50 to about 100 or about 200 or about 500 micrometers in length. The carbon nanotubes can be in multi-walled or single-walled forms, or a mixture thereof. The carbon nanotubes can be either conducting or semi-conducting, with semiconducting nanotubes being particularly useful in embodiments. Variants of carbon nanotubes include, for example, nanofibers, and are encompassed by the term "carbon nanotube materials" unless otherwise stated.

In addition, the carbon nanotubes of the present disclosure can include only carbon atoms, or they can include other atoms such as boron and/or nitrogen, such as equal amounts of born and nitrogen. Examples of carbon nanotube material variants thus include boron nitride, bismuth and metal chalcogenides. Combinations of these materials can also be used, and are encompassed by the term "carbon nanotube materials" herein. In embodiments, the carbon nanotube material is desirably free, or essentially free, of any catalyst material used to prepare the carbon nanotubes. For example, iron catalysts or other heavy metal catalysts are typically used for carbon nanotube production. However, it is desired in embodiments that the carbon nanotube material not include any residual iron or heavy metal catalyst material.

In embodiments, the carbon nanotubes can be incorporated into the photogenerating layer in any desirable and effective amount. For example, a suitable loading amount can range from about 0.5 or from about 1 weight percent, to as high as about 50 or about 60 weight percent or more. However, loading amounts of from about 1 or from about 5 to about 20 or about 30 weight percent may be desired in some embodiments. Thus, for example, the photogenerating layer in embodiments could comprise about 1 to about 2 percent by weight photogenerating pigment, about 50 to about 60 percent by weight polymer binder, about 30 to about 40 percent by weight hole transport small molecule, and about 5 to about 20 percent by weight carbon nanotube material, although amounts outside these ranges could be used.

A benefit of the use of carbon nanotube materials in photogenerating layers is that charge transport or conduction by the nanotube materials is predominantly electrons. The small size of the carbon nanotube materials also means that the carbon nanotube materials provide low scattering efficiency and high compatibility with the polymer binder and small molecule charge transport materials in the layer. Although not limited by theory, it is believed that the electron conduction mechanism through the resultant photogenerating layer is by charge hopping channels formed by closely contacted nanotubes. Further, the carbon nanotube materials may improve photosensitivity of the photogenerating layer, in both positive and negative charging modes.

Additional details regarding carbon nanotubes and their charge transport mobilities can be found, for example, in T. Durkop et al., "Extraordinary Mobility in Semiconducting Carbon Nanotubes," Nano. Lett., Vol. 4, No. 1, 35-39 (2004), the entire disclosure of which is incorporated herein by reference.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the photogenerating layer may be fabricated in a dot or line pattern. Removing the solvent of a solvent coated layer may be effected by any suitable conventional technique such as oven drying, infrared radiation drying, air drying and the like.

Generally, the thickness of the photogenerating layer is between about 10 and about 50 micrometers, but thicknesses outside this range can also be used. The photogenerating layer should be an insulator to the extent that the electrostatic charge placed on the layer is not conducted in the absence of illumination at a rate sufficient to prevent formation and retention of an electrostatic latent image thereon. The photogenerating layer is also substantially non-absorbing to visible light or radiation in the region of intended use but is electrically "active" in that it allows the generation and injection of photogenerated holes and allows these holes to be transported through itself to selectively discharge a surface charge on the surface of the active layer.

To improve photoreceptor wear resistance, a protective overcoat layer can be provided over the photogenerating layer (or other underlying layer). Various overcoating layers are known in the art, and can be used as long as the functional properties of the photoreceptor are not adversely affected.

Advantages provided by the present disclosure include, in embodiments, photoreceptors having desirable electrical and functional properties. For example, photoreceptors in embodiments have improved photosensitivity of the photogenerating layer in both positive and negative charging modes.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. In those environments wherein the device is to be used in a printing mode, the imaging method involves the same steps with the exception that the exposure step can be accomplished with a laser device or image bar.

It will be appreciated that various of the above-disclosed and other features and functions, or alternatives thereof, may be desirably combined into many other different systems and applications. Also that various presently unforeseen or unanticipated alternatives, modifications, variations or improvements therein may be subsequently made by those skilled in the art which are also intended to be encompassed by the following claims.

What is claimed is:

1. An electrophotographic imaging member comprising:

a substrate, an optional intermediate layer, a photogenerating layer that performs both charge generating and hole transport functions, and an optional overcoating layer wherein the photogenerating layer comprises a carbon nanotube material that is from about 0.1 to about 50 nanometers in diameter and from about 0.01 to about 500 micrometers in length; and the photogenerating layer contains about 5 to about 20 percent by weight carbon nanotube material.

2. The electrophotographic imaging member of claim 1, wherein said carbon nanotube material is in a form of carbon nano fibers.

3. The electrophotographic imaging member of claim 1, wherein said carbon nanotube material is in a form of carbon nanotubes.

4. The electrophotographic imaging member of claim 1, wherein said carbon nanotube material is selected from the group consisting of materials containing only carbon atoms, and materials containing carbon atoms and equal amounts of boron and nitrogen.

5. The electrophotographic imaging member of claim 1, wherein said carbon nanotube material is selected from the group consisting of bismuth and metal chalcogenides.

6. The electrophotographic imaging member of claim 1, wherein said carbon nanotube material is electrically conducting.

7. The electrophotographic imaging member of claim 1, wherein the substrate is selected from the group consisting of a layer of electrically conductive material and a layer of electrically non-conductive material having a surface layer of electrically-conductive material.

8. The electrophotographic imaging member of claim 1, wherein the substrate is in a form of an endless flexible belt, a web, a rigid cylinder, or a sheet.

9. The electrophotographic imaging member of claim 1, further comprising at least one of a hole blocking layer and an adhesive layer, between said substrate and said photogenerating layer.

10. The electrophotographic imaging member of claim 1, wherein the photogenerating layer further comprises a film-forming binder, a charge generating material, and a charge transporting material.

11. The electrophotographic imaging member of claim 10, wherein:

the film-forming binder is selected from the group consisting of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, copolymers of the above polymers, and mixtures thereof;

the charge generating material comprises an organic pigment selected from the group consisting of quinacridones, polycyclic pigments, perylene and perinone diamines, polynuclear aromatic quinones, azo pigments, phthalocyanines, and mixtures thereof; and the charge transporting material is selected from the group consisting of pyrazolines, diamines, hydrazones, oxadiazoles, stilbenes, and mixtures thereof.

12. The electrophotographic imaging member of claim 10, wherein the charge transporting material and the carbon nanotube material are both molecularly dispersed in the film-forming binder.

13. The electrophotographic imaging member of claim 10, comprising:

about 1 to about 2 percent by weight photogenerating pigment, about 50 to about 60 percent by weight polymer binder, about 30 to about 40 percent by weight charge transporting material, and about 5 to about 20 percent by weight carbon nanotube material.

14. A process for forming an electrophotographic imaging member comprising:

providing an electrophotographic imaging member substrate, and applying a photogenerating layer that performs both charge generating and hole transport functions over the substrate, wherein the photogenerating layer comprises a carbon nanotube material that is from about 0.1 to about 50 nanometers in diameter and from about 0.01 to about 500 micrometers in length; and the photogenerating layer contains about 5 to about 20 percent by weight carbon nanotube material.

15. The process of claim 14, wherein the applying comprises:

applying a photogenerating layer solution comprising a film-forming binder, a charge generating material, a charge transporting material, and said carbon nanotube material to said substrate; and curing said photogenerating layer solution to form said photogenerating layer.

16. The process of claim 15, wherein the photogenerating layer solution is formed by forming a solution of said film-forming binder, said charge generating material, said charge transporting material, and said carbon nanotube material in a solvent.

17. An electrographic image development device, comprising an electrophotographic imaging member comprising:

a substrate, an optional intermediate layer, a photogenerating layer that performs both charge generating and hole transport functions, and an optional overcoating layer wherein the photogenerating layer comprises a carbon nanotube material that is from about 0.1 to about 50 nanometers in diameter and from about 0.01 to about 500 micrometers in length; and the photogenerating layer contains about 5 to about 20 percent by weight carbon nanotube material.

* * * * *